US005139180A

United States Patent [19]

Lucas

[11] Patent Number: 5,139,180

[45] Date of Patent: Aug. 18, 1992

[54] CAP FOR A FLASK WITH A SPRAYER

[76] Inventor: Marthe Lucas, 22 allée des Fauvettes, 34280 La Grande motte, Hérault, France

[21] Appl. No.: 821,916

[22] Filed: Jan. 16, 1992

Related U.S. Application Data

[63] Continuation of Ser. No. 485,896, Mar. 1, 1990, abandoned.

[30] Foreign Application Priority Data

Mar. 1, 1989 [FR] France ..... 89 02653

[51] Int. Cl.[5] ..... B65D 83/00

[52] U.S. Cl. ..... 222/402.13; 222/509; 251/251

[58] Field of Search ..... 222/182, 402.11, 402.12, 222/402.13, 402.1, 509; 251/251, 263

[56] References Cited

U.S. PATENT DOCUMENTS

| | | | |
|---|---|---|---|
| 3,236,421 | 2/1966 | Glazier | 222/402.13 |
| 3,323,690 | 6/1967 | Monahon | 222/402.13 |
| 3,404,814 | 10/1968 | Wakeman | 222/402.13 |
| 3,409,186 | 11/1968 | Melocchi | 222/402.13 |
| 3,739,941 | 6/1973 | Ostrwosky | 222/402.13 |
| 4,138,039 | 2/1979 | Micallef | 222/321 |
| 4,264,038 | 4/1981 | Nozawa | 222/321 X |
| 4,277,004 | 7/1981 | Barlics | 222/402.13 |
| 4,620,646 | 11/1986 | Crapser | 222/402.13 |
| 4,640,493 | 2/1987 | Dudzik | 222/509 X |
| 4,679,713 | 7/1987 | Crapser et al. | 222/402.13 |
| 4,776,491 | 10/1988 | Nitta | 222/402.11 |

FOREIGN PATENT DOCUMENTS

| | | | |
|---|---|---|---|
| 2715360 | 10/1978 | Fed. Rep. of Germany | 222/402.1 |

*Primary Examiner*—Kevin P. Shaver
*Assistant Examiner*—Kenneth Bomberg
*Attorney, Agent, or Firm*—Browdy and Neimark

[57] ABSTRACT

The cap is provided with a distributing mouth piece comprising a movable distributing part with lateral opening having to be pressed in order that a liquid or a cream is distributed by operating a pump or a valve. The cap comprises operating means of the mouth piece which is axially pressed under effect of a lateral push exerted on the operating means. A cover delimits apertures or notches for wings or for at least one half-shell handling said operating means guided by the cover connected to the flask by fixation means.

4 Claims, 3 Drawing Sheets

FIG. 1
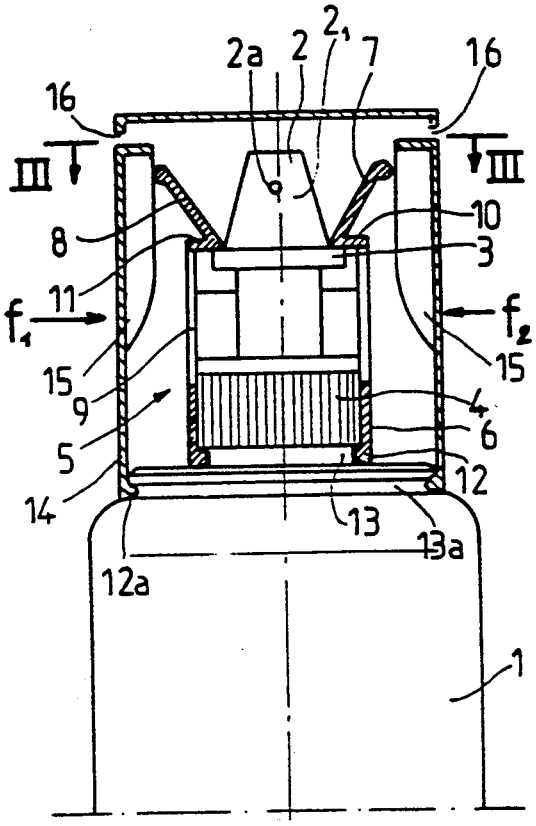
FIG. 2
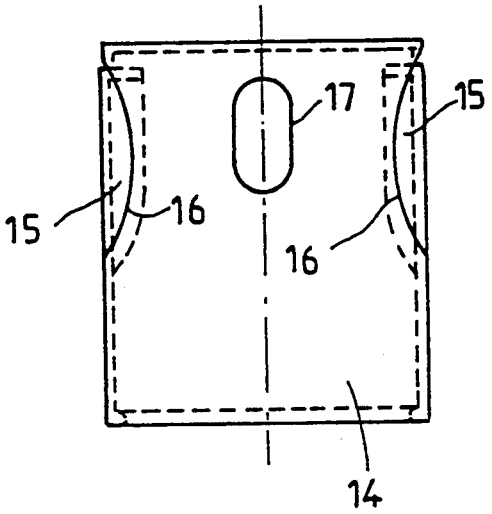
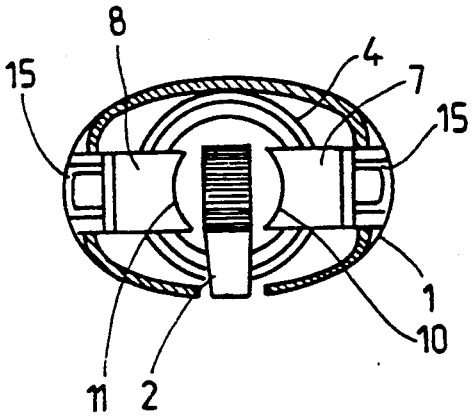
FIG. 3

FIG.7
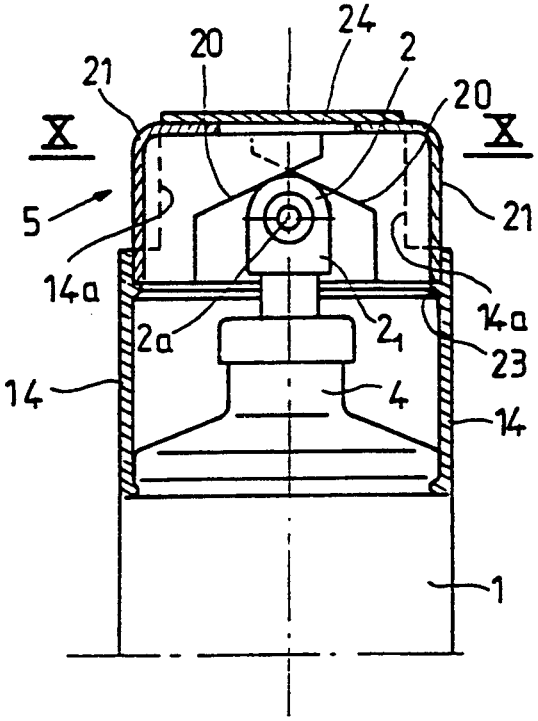
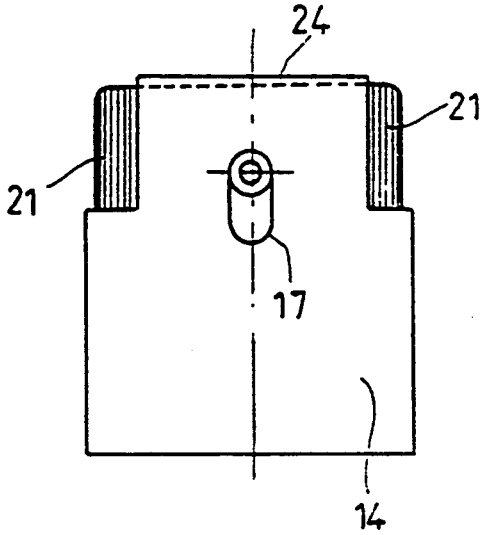
FIG.8
FIG.9
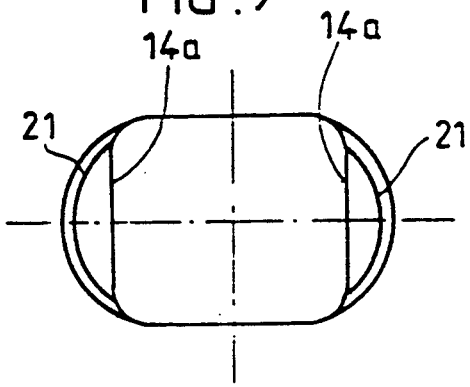
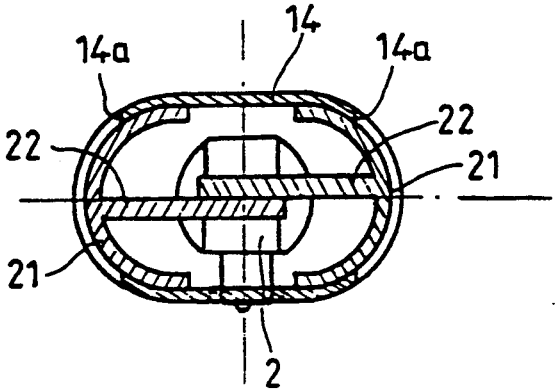
FIG.10
FIG.11
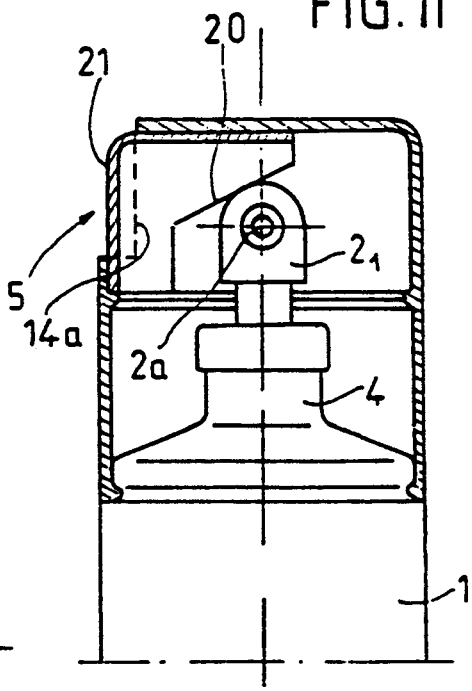

CAP FOR A FLASK WITH A SPRAYER

This application is a continuation of application Ser. No. 485,896, filed Mar. 1, 1990 now abandoned.

FIELD AND BACKGROUND OF THE INVENTION

The present invention relates to a cap arrangement for a flask with a sprayer.

Various products which are liquid or in the form of creams are contained in flasks provided with a distributing mouth piece.

For operating the distributing mouth piece, it is necessary for the user to maintain the flask in his hand and to exert a pressure, for example by means of his forefinger, on the top of the distributing mouth piece.

The product is sprayed, atomised or similarly distributed by exerting successive pressures on the distributing mouth piece when the same controls a pump, or by maintaining it pressed when the flask is provided with a propulsive charge.

It has been found that the movements made for both maintaining the flask and exerting a pressure on the distributing mouth piece were not rational.

Consequently, the invention comes from the finding that, as soon as a manual tightening is exerted in a substantially horizontal plane on the flask, it is also necessary to exert an effort on the same plane on the means for operating the distributing mouth piece.

The problem is solved by the present invention.

SUMMARY OF THE INVENTION

According to the invention, the cap arrangement for a flask with a sprayer provided with a distributing mouth piece comprising a movable distributing part with lateral opening having to be pressed in order that a liquid or a cream is sprayed, atomised or similarly distributed by operating a pump or a valve, said cap comprising operating means of said mouth piece which is axially pressed under effect of a lateral push exerted on said operating means, is characterized by a cover delimiting apertures or notches for wings or for at least one shell handling the operating means guided by the cover connected to the flask by fixation means.

Various other features of the invention will moreover be revealed from the following detailed disclosure.

BRIEF DESCRIPTION OF THE INVENTION

Embodiments of the invention are shown as non limitative examples in the accompanying drawings, in which:

FIG. 1 is a cross sectional elevation view illustrating the various parts of a flask with a sprayer and those of the control device, according the invention;

FIG. 2 is a partial elevation view showing the cover of the flask;

FIG. 3 is a cross section, as viewed from above, of the flask provided with the inventive control device, the cover of the flask being withdrawn;

FIG. 7 is a cross section elevational view similar to FIG. 1 of a third variant of embodiment;

FIG. 8 is a side elevational view corresponding to FIG. 7;

FIG. 9 is a top view corresponding to FIGS. 7 and 8;

FIG. 10 is a cross section viewed along line X—X of FIG. 7;

FIG. 11 is a cross sectional elevation view similar to FIG. 7 showing a simplified embodiment.

DESCRIPTION OF THE PREFERRED EMBODIMENTS

Figure 5:
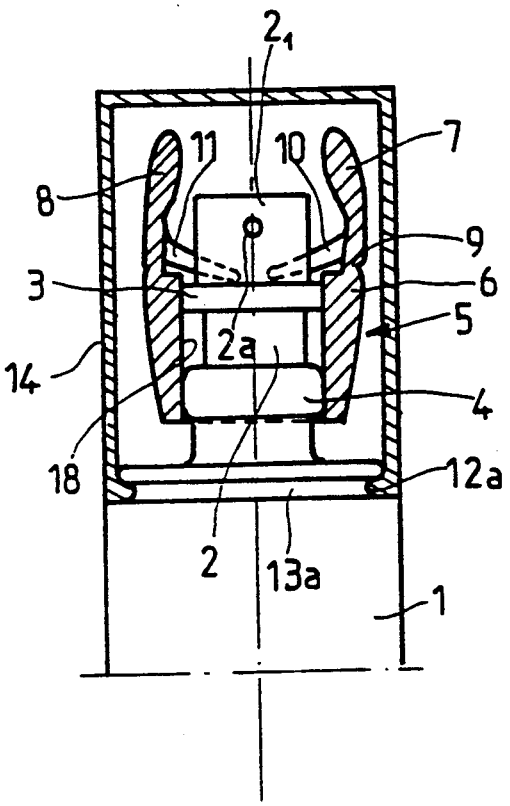
FIG. 5 is a partial cross sectional elevation view similar to FIG. 1, but corresponding to the variant of embodiment of FIG. 4.

In the drawings, reference numeral 1 designates a flask containing a liquid or creamy product having to be sprayed, atomised or samely distributed by exerting a pressure on a distributing part $2_1$ of a distributing mouth piece 2 covering a neck 4 of the flask 1.

The distributing part $2_1$ of the distributing mouth piece 2 can be made by the piston of a pump or by the control member of a valve when the flask 1 contains a liquid, or a cream, having to be projected under the action of a pressurised gas or vapor that the flask 1 also contains.

The distributing mouth piece 2 of FIGS. 1–6 comprises, as this is frequently the case, a flange 3 protruding at its base from the neck 4 of the flask 1. The top portion of the distributing part $2_1$ of the distributing mouth piece 2 can be flat or arcuate.

In the embodiment of the drawing, the control device is generally designated at 5 and comprises, in FIGS. 1 to 6, a fixation skirt 6 extended by operating means formed by levers 7, 8 to which the skirt is connected by a flexible part or hinge 9.

The levers 7 and 8 are connected to the flexible parts 9 by lugs 10, 11 having substantially the shape of a stirrup bearing on the flange 3.

The skirt 6 comprises at its base a keeper ring or other fixation means 12 engaged, by resilient deformation, into a groove 13 of the neck 4, which provides a connection of the control device 5 to the flask 1.

The flask 1 forms, besides, itself, a second groove **13*a* for a keeper ring or other fixation means 12*a* of a cover 14**.

As shown in FIGS. 1 and 2, articulated wings 15 are provided in the cover 14 within apertures 16 in correspondence with the levers 7, 8.

A hole 17 (FIG. 2) corresponds to the distributing part $2_1$ of the distributing mouth piece 2 which has a distributing opening **2*a***.

For operating the distributing means 2 after withdrawal of the cover 14, it suffices for the user, by means of his thumb and forefinger, to exert a pressure in direction of the arrows $f_1$, $f_2$ on the wings 15, which has for its effect to pivot the levers 7, 8 so that the stirrup shaped lugs 10, 11 will rock and exert a pressure on the flange 3, thereby causing operation of the distributing part $2_1$ of the distributing mouth piece 2 and, consequently, a spraying, an atomisation or a similar distribution of the liquid or creamy product contained in the flask 1.

It is also possible to leave the cover 14 in place and to press on the articulated wings 15 which then operate the levers 7, 8. In such a case, the opening **2*a* is moved while still coinciding with the hole 17**.

It is advantageous, in a variant of embodiment, that the groove **13*a* has an abutment or interruption, and that the keeper ring 12*a* is not continuous in order that the cover 14 may take a first position for which the wings 15 are not facing the lugs 7, 8 and for which the hole 17 is itself shifted from the opening 2***a* of the distributing mouth piece 2, and a second position in which there is coincidence, thereby permitting a protection of said distributing mouth piece 2, for example when the flask 1 must be placed in a travelling toilet-case. Other means in the art enabling to bring the cover 14 in two distinct different position can obviously be embodied and are part of the common knowledge of the man skilled in the art.

Figure 4:
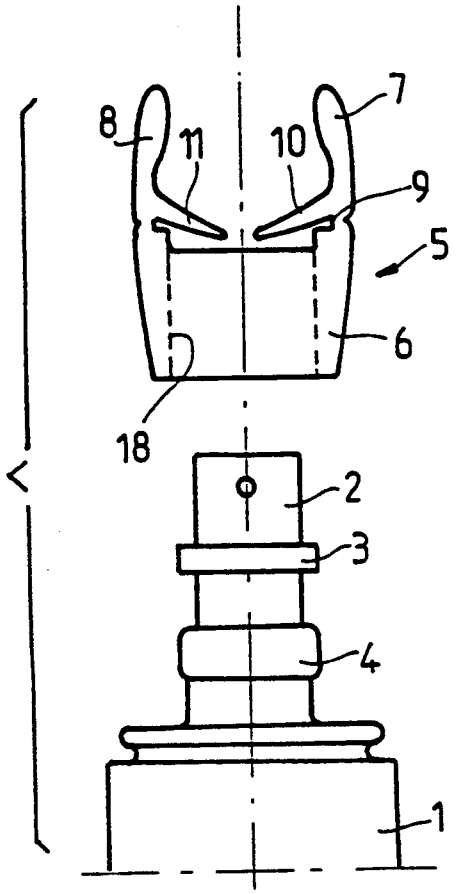
FIG. 4 is an exploded elevation view of a first variant of embodiment.

FIGS. 4 and 5 show a variant of embodiment according to which the control device is made to be adapted to pre-existing flasks.

In FIGS. 4 and 5, the skirt 6 forms a sheath having an inner wall 18 which is slightly force engaged onto the neck 4 up to when the stirrup shaped lugs 10, 11 come to bear on the flange 3.

FIG. 5 shows that, in this embodiment, the control device can be completely contained in the space remaining free because of the cover 14*a* encasing the top portion of the flask 1, and the keeper ring 12*a* or other fixation means of which is engaged into the groove 13*a* of the flask 1.

After withdrawal of the cover 14, it suffices to exert a lateral push on the levers 7, 8 able to pivot about the thinnered part 9 so that the lugs 10, 11 will operate the flange 3 of the distributing part $2_1$ of the distributing mouth piece 2.

Figure 6:
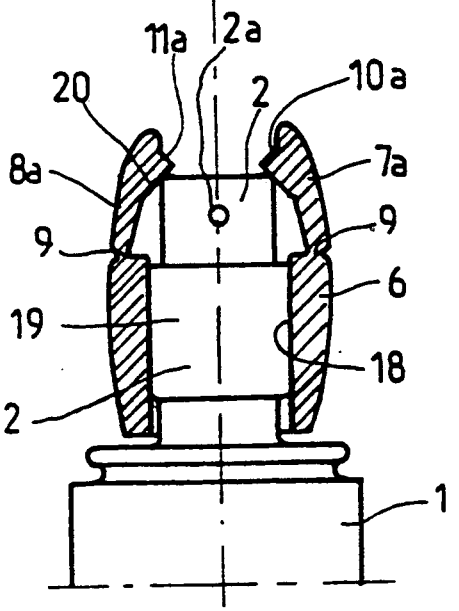
FIG. 6 is a partial cross sectional elevation view showing a second variant of embodiment.

FIG. 6 shows a modification which is advantageous of carrying into effect in flasks having a distributing part of the distributing mouth piece 2 which does not comprise a flange 3, as previously, but must directly slide in a cylindrical guide 19 forming the fixed part of the distributing mouth piece 2.

In such a case, the levers 7*a*, 8*a* which can pivot about the hinge-forming thinnered or flexible parts 9 comprise, at the top of the distributing mouth piece 2, a set of operating lugs 10*a*, 11*a* having a bottom portion for forming cams 20.

Upon the pivoting of the levers 7*a*, 8*a*, two actions are conjugated, namely a sliding action of the cams 20 which slide on the top portion of the distributing mouth piece 2, and a pivoting action of these cams 20 due to the rocking of the levers 7*a*, 8*a*.

FIG. 6 shows the control device in its embodiment as an adaptation, i.e. that its skirt 6 forms a sheath having an inner wall 18 which is slightly force engaged on the cylindrical guide 19. It is obvious that the skirt 6 could be made as shown in FIGS. 1-3.

In FIGS. 7-10, the cover 14 forms two notches 14*a* through which protrude two sliding half-shells 21. opposed respectively. The half-shells 21 constitute operating means and form, therefore, a set of cams 20 bearing each by a narrow adjacent part 22 on a top portion of the movable distributing part $2_1$ of the distributing mouth piece 2, with this top portion being preferably arcuate, as shown. The two half-shells 21 are guided by internal circumferential rib 23 and the top portion 24 of the cover 14. The resilient force exerted by the distributing part $2_1$ acting on the cams 20, tends to push back the half-shells 21 in the position shown in the drawing so that they normally block the notches 14*a*.

The embodiment shown in the drawings provides that the two half shells 21 are in particular mutual overlapping engagement at the zone thereof in which the narrow adjacent parts 22 are in contact together and form a small surface bearing with only a small friction on top of the distributing mouth piece 2 when activating the same.

In FIG. 11, only one notch 14*a* is provided and samely only one half-shell 21.

For operating the distributing mouth piece, it suffices to push on the single one and/or on the two half-shell 21.

The invention in not restricted to the embodiments shown and described in detail since various modifications thereof can be applied thereto without departing from its scope. In particular, the cover 14 with articulated wings 15 can be embodied in the embodiment of FIGS. 4-6 so that the wings 15 will be used for operating the lugs 7, 8 without it is necessary to withdraw the cover. Samely, the flask 1 and cover 14 can have any shape in cross section.

I claim:

1. A cap arrangement for a flask with a distributing mouth piece comprising a movable distributing part with a lateral distributing opening, said movable distributing part having to be pressed down in order that a liquid or a cream be distributed through said lateral distributing opening, said cap arrangement comprising, a cover for said flask, said cover having a hole coinciding with said lateral distributing opening, said cover having an internal circumferential rib, at least one slidable half shell slidably mounted and guided in said cover between a top of said cover and said internal circumferential rib, said cover having at least one notch above said internal circumferential rib for permitting said at least one slidable half shell to be engaged from outside said cover, said cover limiting the outward radial path of said at least one slidable half shell and said distributing mouth piece limiting the inward radial path of said at least one slidable half shell, said at least one slidable half shell having a narrow inclined cam, said narrow inclined cam extending over a top portion of said distributing mouth piece, a small surface of said narrow inclined cam bearing on said top portion of said distributing mouth piece, wherein engaging and pressing said at least one slidable half shell further engages said small surface of said narrow inclined cam to press said distributing mouth piece down to distribute a content of said flask through said lateral distributing opening.

2. The cap arrangement of claim 1, having two slidable half shells slidably mounted and guided in said cover between said top of said cover and said internal circumferential rib, said cover having two notches above said internal circumferential rib for permitting said two slidable half shells to be engaged from outside said cover, said cover limiting the outward radial path of said two slidable half shells and said distributing mouth piece limiting the inward radial path of said two slidable half shells, each of said two slidable half shells having a narrow inclined cam, each narrow inclined cam extending over a top portion of said distributing mouth piece, a small surface of said each narrow inclined cam bearing on said top portion of said distributing mouth piece, and a broad width of said each narrow inclined cam in side-by-side slidable engagement with each other over said top portion of said distributing mouth piece, wherein engaging and pressing said two slidable half shells further engages said small surface of said each narrow inclined cam to press said distributing mouth piece down to distribute a content of said flask through said lateral distributing opening.

3. The cap arrangement of claim 2, wherein said top portion of said distributing mouth piece is arcuate.

4. The cap arrangement of claim 2, wherein said narrow inclined cam extends over a central top portion of said distributing mouth piece.

* * * * *